US006661388B2

(12) United States Patent
Desargant et al.

(10) Patent No.: US 6,661,388 B2
(45) Date of Patent: Dec. 9, 2003

(54) FOUR ELEMENT ARRAY OF CASSEGRAIN REFLECTOR ANTENNAS

(75) Inventors: Glen J. Desargant, Fullerton, CA (US); Albert Louis Bien, Anaheim, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/143,473

(22) Filed: May 10, 2002

(65) Prior Publication Data

US 2003/0210202 A1 Nov. 13, 2003

(51) Int. Cl.[7] ..... H01Q 3/00
(52) U.S. Cl. ..... 343/766; 343/705; 343/765
(58) Field of Search ..... 343/705, 757, 343/761, 765, 766, 878, 879, 882

(56) References Cited

U.S. PATENT DOCUMENTS 5,579,018 A * 11/1996 Francis et al. ..... 343/757
5,666,124 A * 9/1997 Chethik et al. ..... 342/383
6,188,367 B1 * 2/2001 Morrison et al. ..... 343/765
6,285,338 B1 * 9/2001 Bai et al. ..... 343/882
6,559,805 B2 * 5/2003 Yamauchi et al. ..... 343/766

* cited by examiner

*Primary Examiner*—Don Wong
*Assistant Examiner*—Shih-Chao Chen
(74) *Attorney, Agent, or Firm*—Harness Dickey & Pierce P.L.C.

(57) ABSTRACT

A multi-reflector antenna array capable of simultaneously transmitting and receiving communication signals at Ku-band frequencies is mounted on an exterior surface of an aircraft. The antenna array provides four cassegrain reflector antennas mechanically connected together in a group capable of being simultaneously mechanically scanned. A common support structure fixes the antennas with respect to each other. A drive mechanism and directional azimuth and elevation motors control the position of the array. The aerodynamic drag of the array is minimized using four antennas rather than a single large diameter antenna. Each antenna is positioned on a common horizontal centerline. Two centrally located antennas are positioned between two smaller diameter antennas. The antennas and positioning equipment are both mounted for rotation within a radome. A corporate power combiner/divider is provided to adjust both an amplitude and a phase of each antenna signal.

21 Claims, 6 Drawing Sheets

FOUR ELEMENT ARRAY OF CASSEGRAIN REFLECTOR ANTENNAS

FIELD OF THE INVENTION

The present invention relates generally to RF communication antennas, and more specifically to aircraft Ku-band communication antenna systems required to simultaneously transmit and receive from a single aperture

BACKGROUND OF THE INVENTION

Aircraft mounted Ku-band communication antenna systems presently operate in receive only mode. There is a need for an aircraft mounted, Ku-band communication antenna system which can simultaneously transmit and receive from a single aperture. For this system, International Telecommunication Union (ITU) regulatory levels apply such that transmit Effective Isotropic Radiated Power (EIRP) antenna pattern levels cannot exceed ITU regulatory levels for Ku-band satellite interference.

A drawback of the currently used receive-only antennas is that their wide beam widths and high sidelobes cannot meet the beam width and sidelobe requirements for transmit operation under the ITU Ku-band satellite regulations. Use of conventional rectangular slotted waveguide and microstrip-patch array technology cannot be employed because of the high transmit to receive isolation, high efficiency and high cross polarization performance required over the combined transmit and receive operating frequency bandwidth, i.e., about 14.0 GHz to about 14.5 GHz and about 11.2 GHz to about 12.7 GHz respectively.

A large, circular reflector antenna, i.e., approximately 0.9 meters (m) (36 inches) diameter, could be used for the application. Several drawbacks exist, however, for an antenna of this size. The communication antenna(s) is required to be mounted on the external surface of the aircraft fuselage. The vertical height of a 0.9 m diameter antenna creates an aerodynamic vertical drag problem for the aircraft. A further drawback is that aircraft antennas are normally enclosed within a radome in order to protect the antennas and to control aerodynamic drag induced by the antenna(s). As the diameter of an antenna increases, the necessary height and length of the radome increases. The necessary sized radome for a 0.9 m (36 inch) diameter surface mounted reflector antenna produces unacceptable levels of aerodynamic drag.

In addition to the above drawbacks, the effective isotropically radiated power (EIRP) for a single, large antenna and single transmitter is less efficient than an array of smaller antennas and smaller transmitters. Exemplary vertical and horizontal solid state power amplifiers (SSPAs) for a single large antenna producing 20 watts have an efficiency of about 15 percent. The vertical and horizontal SSPAs of four smaller antennas producing an exemplary 5 watts each (for the same total of 20 watts output) have an efficiency of about 25 percent. It is therefore an efficiency drawback to use a single larger antenna if an appropriate number of smaller, more efficient antennas can be employed.

Reducing the antenna diameter, however, necessarily reduces the antenna aperture area. To maintain the total aperture area of a 0.9 m diameter reflector antenna by using a greater number of smaller diameter antennas requires balancing several factors. As noted above, using a plurality of smaller diameter reflector antennas decreases drag while increasing efficiency, but also increases system complexity (wiring, receiver differentiation, etc.). The use of a plurality of smaller reflector antennas requires a common support structure, increasing complexity with each antenna to account for the structure and mechanisms required to jointly mount and rotate the assembly. The antennas must be grouped to permit mechanical scanning with the least number of mechanical components, i.e., motors, wiring or gears, to control complexity and weight. A need therefore exists for a wide-band, low drag, mechanically scanned Ku-band communications antenna system which can simultaneously transmit and receive from a single aperture.

SUMMARY OF THE INVENTION

According to a preferred embodiment of the present invention, there is provided a multiple reflector antenna array. The antenna array includes a plurality of independent reflector antennas with each of the reflector antennas being fixed to a common antenna support structure. The collective group of antennas on the support structure is trainable to simultaneously receive and transmit RF signals. Cassegrain reflector antennas are preferably employed by the present invention. The support structure of the multiple cassegrain reflector antenna assembly is mechanically attached on an exterior surface of a fuselage of an aircraft. The assembly is enclosed within a radome to reduce aerodynamic drag on the aircraft. Multiple reflector antennas reduce the height of the required radome compared to the height of a radome enclosing a single large diameter reflector antenna. Each antenna is required to both simultaneously transmit and receive communication signals within the Ku frequency band. An exemplary transmit frequency is about 14.0 to about 14.5 gigahertz (GHz) and an exemplary receive frequency range is about 11.2 to about 12.7 GHz.

Since multiple reflector antennas are employed by the present invention, a corporate power combiner/divider is employed to process the transmit and receive signals from each of the reflector antennas. Individual service lines to provide both horizontal and vertical signal support to each of the smaller reflector antennas is provided. Through use of the corporate power combiner/divider, the antenna overall pattern performance can be controlled by adjusting each antenna's signal amplitude and phase within a corporate feed network provided. This adjustment is in addition to the amplitude and phase adjustment of the normal feedhorn/reflector system of these antennas.

A radome surrounds the multiple antenna arrangement and its aerodynamic vertical drag component is a function of its height. Radome height is determined by selecting antenna diameter. Radome length is a function of its height. Typically, the radome length is 10 times the radome height to minimize aerodynamic disturbances. Therefore, reducing radome height also reduces radome length and its length component of aerodynamic drag.

The present invention provides a wideband, low drag, mechanically scanned, Ku-band communications antenna system which can simultaneously transmit and receive from a single aperture. An antenna array system of the present invention meets the ITU regulatory levels for Ku-band GEO satellite interference.

In one preferred embodiment of the invention, a multiple element antenna array for both transmitting and receiving communication signals is provided. A plurality of reflector antennas forms an antenna array. The antenna array is arranged on a common horizontal axis. A support structure mounts the antenna array on the common horizontal axis. A drive mechanism permits multiplane movement of the support structure. At least one motor is provided to rotate the drive mechanism.

In another preferred embodiment of the invention, an antenna array is provided to both transmit and receive Ku-band communication signals for a moving platform. The antenna array comprises an array of three to four cassegrain reflector antennas. A support structure is provided for mounting each reflector antenna of the antenna array. A drive mechanism permits movement of the support structure to mechanically scan the array. A first motor controls vertical motion of the drive mechanism. A second motor controls horizontal motion of the drive mechanism. A radome encloses the antenna array. The radome has an internal volume sufficient to permit mechanical scanning of the array within the radome by the first and second motors.

In still another preferred embodiment of the present invention, an aircraft communication system is provided which comprises four cassegrain reflector antennas. A support structure mounts each of the four reflector antennas. A drive mechanism permits mechanical scanning of the support structure. A corporate power combiner/divider is electrically connected with each of the four cassegrain reflector antennas. The combiner/divider processes both a transmit and a receive signal for each of the four cassegrain reflector antennas. A radome encloses all four cassegrain reflector antennas. The radome reduces aerodynamic drag of the four cassegrain reflector antennas.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE PREFERRED EMBODIMENTS

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

Figure 1A:
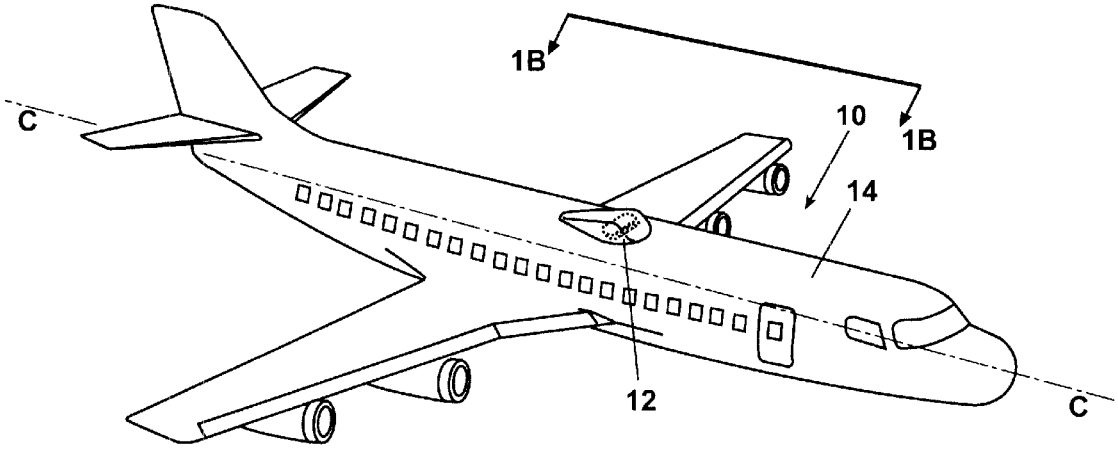
FIG. 1A is a perspective view of an aircraft employing a communication system and its radome of the present invention.
Figure 1B:
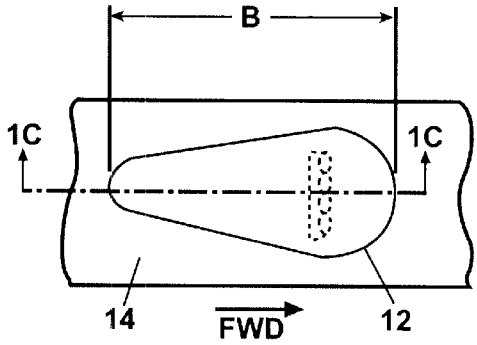
FIG. 1B is a plan view taken along Section 1B—1B of FIG. 1A showing the radome.
Figure 1C:
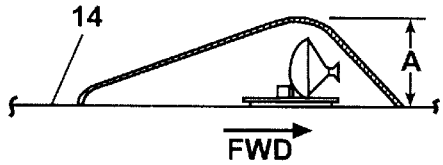
FIG. 1C is a partial section view taken along Section 1C—1C of FIG. 1B showing a portion of the reflector antenna array of the present invention within the radome.

Referring to FIGS. 1A through 1C, an exemplary aircraft 10 is shown on which an antenna system of the present invention is mounted. A radome 12 having height A and length B is shown on an upper surface of the aircraft fuselage 14. Radome height A shown in FIG. 1C is determined primarily by the diameter of the individual antenna(s) employed in the antenna system. Radome length B shown in FIG. 1B is determined by the radome height A and increases in length in direct proportion to the height of the antenna equipment provided within radome 12. The location of radome 12 shown in FIG. 1A is exemplary of a preferred location adjacent to a plane perpendicular to the aircraft longitudinal axis C at the wing leading edge D. However, the radome 12 can also be located in multiple locations along the crown of the fuselage 14 of crown of the aircraft 10.

Figures 2A, 2B:
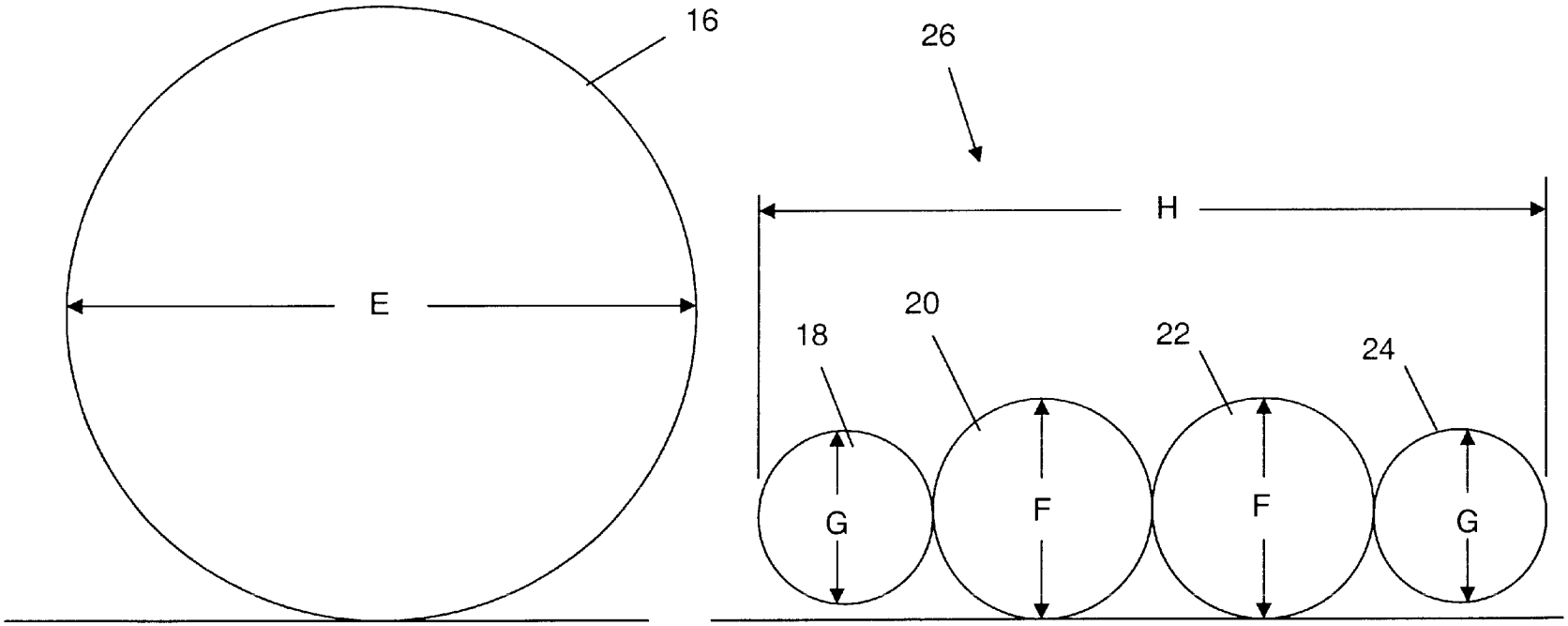
Fig. 2A Prior Art
FIG. 2A is a block diagram of a single circular reflector antenna.
FIG. 2B is a simplified drawing of a multiple circular reflector antenna array of the present invention.

Referring to FIG. 2A, a single, circular reflector antenna 16 is shown. Single reflector antenna 16 is required to have a diameter E in order to both simultaneously transmit and receive Ku-band communication signals. The single reflector antenna 16 would have an exemplary diameter of about 0.9 m (36 inches). A 0.9 meter diameter antenna mounted within a suitably sized radome on the aircraft fuselage 14 would produce unacceptable drag levels. Referring to FIG. 2B, the preferred embodiments of the present invention therefore employ multiple preselected, smaller diameter, wide bandwidth, high gain, fan beam antennas mounted on the aircraft fuselage 14.

One embodiment of the present invention provides four reflector antennas: a first reflector antenna 18, a second reflector antenna 20, a third reflector antenna 22 and a fourth reflector antenna 24 combined to form an antenna array 26. Second reflector antenna 20 and third reflector antenna 22 each comprise a first diameter F. First reflector antenna 18 and fourth reflector antenna 24 each comprise a diameter G smaller than diameter F. An exemplary dimension for diameter F for the array centrally located reflector antennas, comprising second reflector antenna 20 and third reflector antenna 22, is about 0.25 meters (10.0 inches). An exemplary dimension for diameter G for the antenna array 26 adjacently mounted reflector antennas, comprising first reflector antenna 18 and fourth reflector antenna 24, is about 0.20 meters (8.0 inches).

Reducing antenna height by employing four smaller diameter antennas in antenna array 26 rather than the single reflector antenna 16 reduces the height A of radome 12 (shown in FIG. 1), which will reduce aerodynamic drag. FIGS. 2A and 2B compare single reflector antenna 16 having diameter E to the horizontally configured antenna array 26. The array width H of the four antenna array 26 is about equal to the diameter E of single reflector antenna 16, however, the aerodynamic drag of the four antenna array 26 is considerably lower because of reduced antenna diameters F and G which permits a shorter radome height A and length B.

Figure 3:
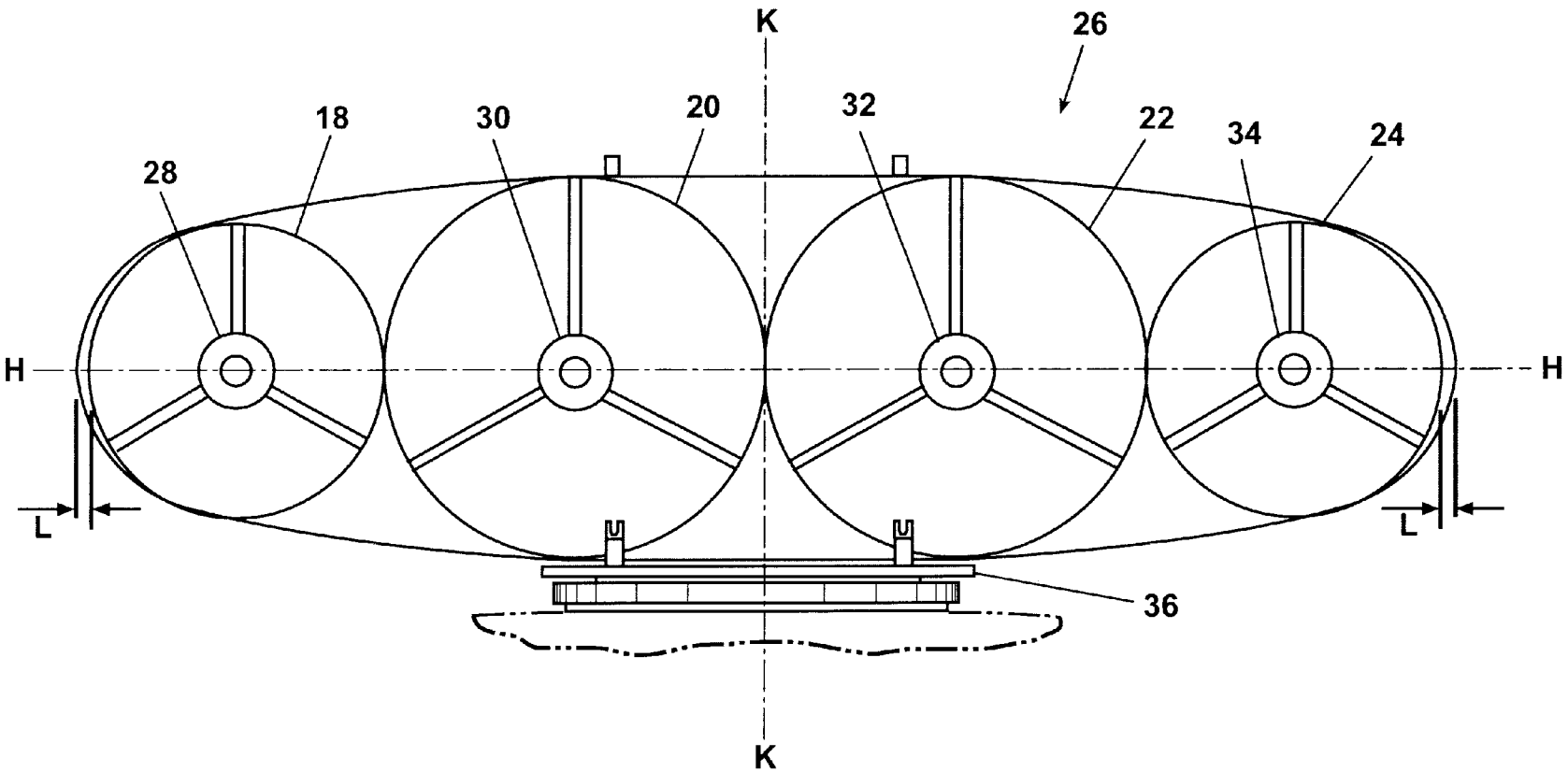
FIG. 3 is a front elevational view of a four-antenna array of the present invention.
Figure 4:
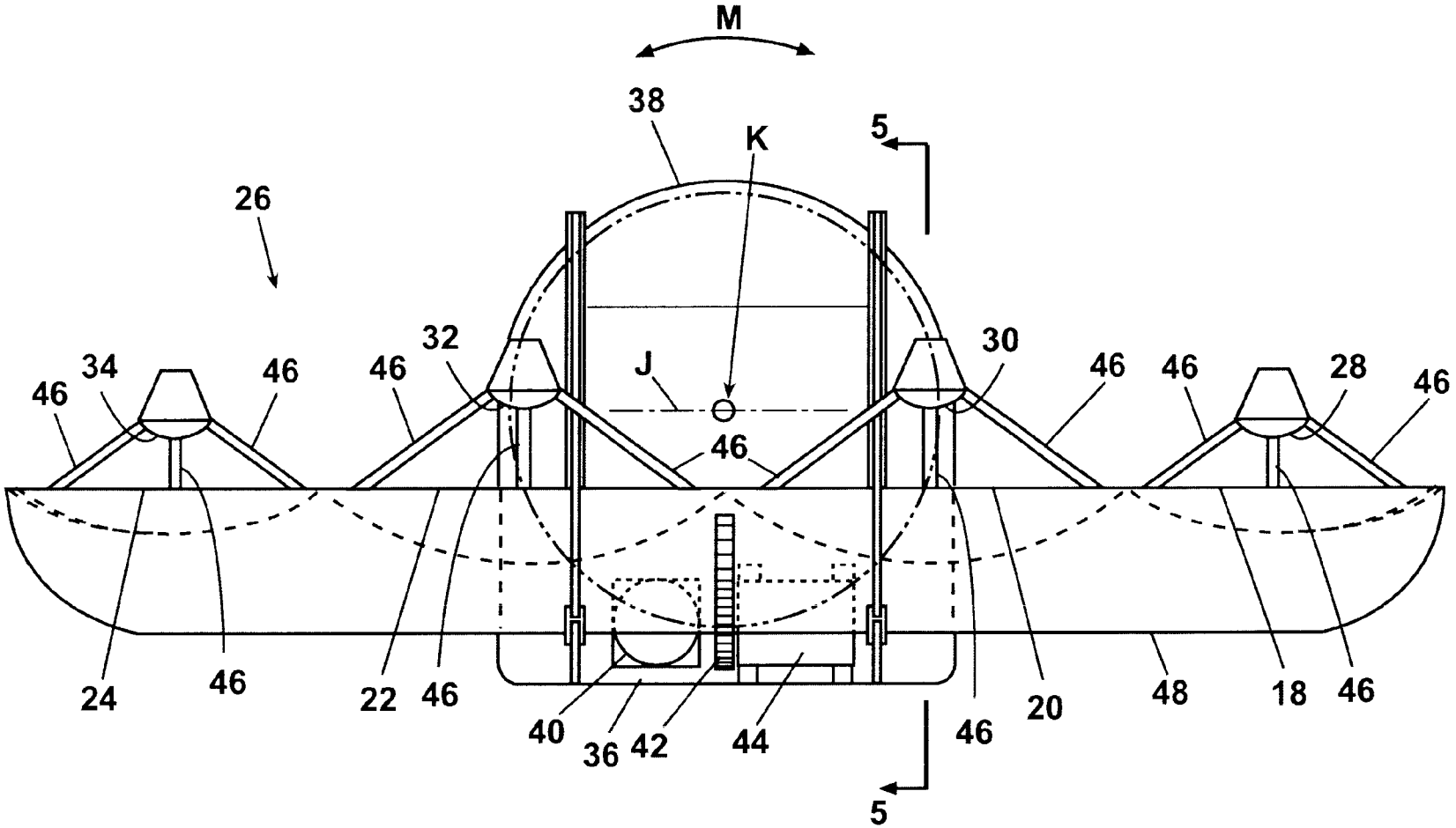
FIG. 4 is a plan view of a four-antenna array of the present invention.
Figure 5:
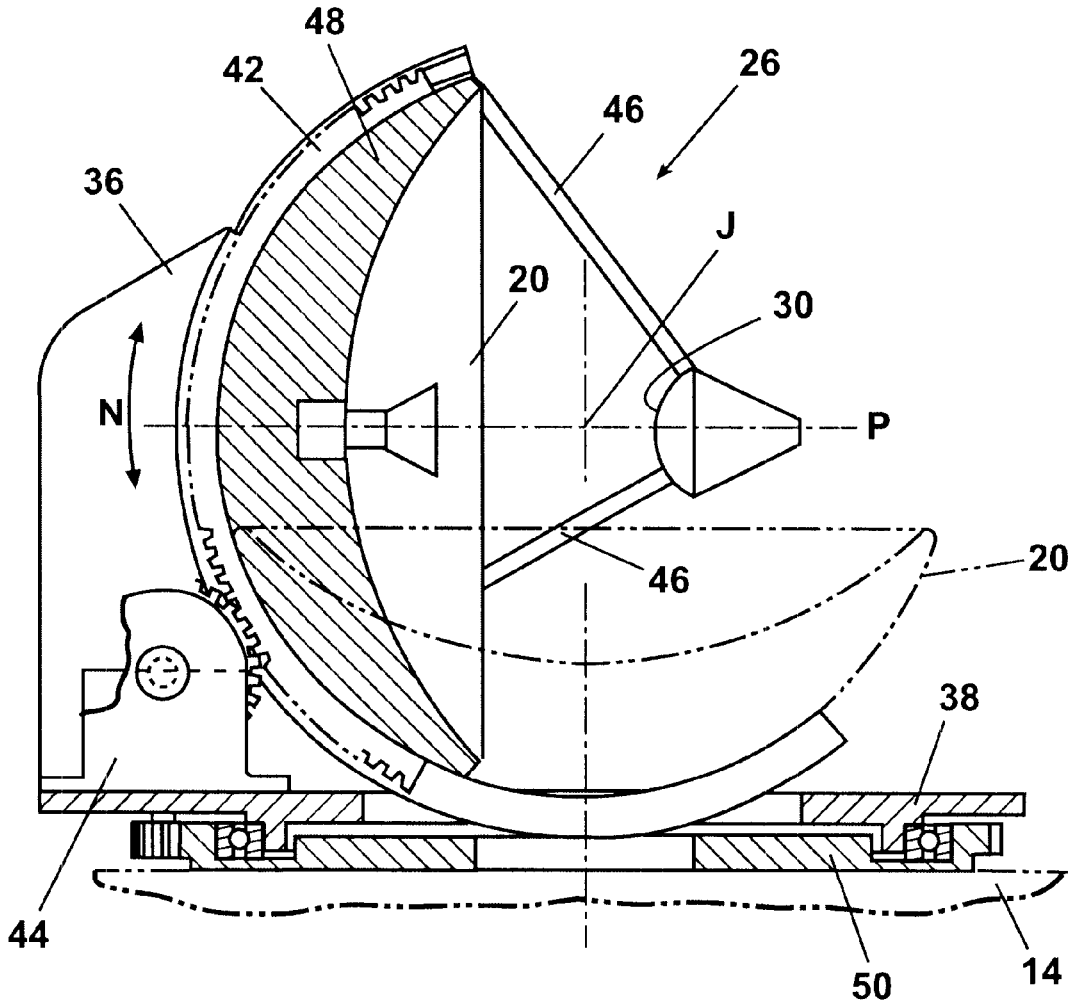
FIG. 5 is a partial side cross sectional view of the four-antenna array of FIG. 4 taken along section line 5—5 in FIG. 4.

Referring now to FIGS. 3 through 5, a more detailed illustration of the antenna array 26 of the present invention is shown. The reflector antennas 18, 20, 22 and 24 each have a sub-reflector 28, 30, 32, and 34 respectively. Each reflector antenna 18, 20, 22 and 24 is mounted to an antenna support structure 36. Antenna support structure 36 supports each reflector antenna 18, 20, 22 and 24 on a common horizontal centerline H. The antenna support structure 36 also provides a vertical centerline K for the antenna array 26 between second reflector antenna 20 and third reflector antenna 22 as shown. The vertical centerline K forms the azimuthal axis of rotation for the antenna array 26. A space L on both ends of the antenna array 26 is filled with a radar absorbing material (RAM) to reduce or eliminate spurious radiation.

FIG. 4 shows a plan view of the antenna array 26 supported by the antenna support structure 36. The antenna support structure 36 comprises a geared platen 38 which is rotated by an azimuth stepper motor 40 about an axis of rotation of vertical centerline K in the directions indicated as arrow M. A semi-spherical geared support member 42 is rotationally supported to the support structure 36 allowing antenna array 26 to be rotated by an elevation stepper motor 44 in engagement with the semi-spherical geared support member 42 about elevation rotation axis J. Reflector antennas 18, 20, 22 and 24 preferably comprise Cassegrain reflector antennas. Each sub-reflector 28, 30, 32, and 34 is secured to its respective reflector antenna by a plurality of sub-reflector struts 46. A support structure 36 rear face 48 is shown which covers at least the rearward facing surface areas of the combined antennas of antenna array 26. In a preferred embodiment, rear face 48 comprises a graphite/epoxy covered foam to help align and support reflector antennas 18, 20, 22 and 24.

FIG. 5 shows a simplified cross sectional side view of the arrangement of FIG. 4 taken along section 5—5 of FIG. 4. The mechanism for supporting and rotating the four element antenna array 26 of the present invention is shown. Elevation stepper motor 44 provides the driving force for positioning the antenna array 26 in accordance with a desired elevation angle. A portion of semi-spherical support member 42 is geared and in mechanical communication with elevation stepper motor 44 to rotate the antenna array 26 about elevation rotation axis J in the directions indicated by arrow N. The support structure 36 employs the rear face 48 to cover and protect the antenna array 26. As shown in FIG. 1C, the radome 12 has sufficient internal volume and height to permit scanning the antenna array 26 within the radome 12 in the directions indicated as arrow N in FIG. 5.

FIG. 5 shows an exemplary second reflector antenna 20, with its sub-reflector 30 secured to the second reflector antenna 20 by the sub-reflector struts 46, in a first extreme rotation position with the sub-reflector centerline P horizontal. FIG. 5 further shows a phantom view of the second reflector antenna 20 in its opposite maximum rotated position having sub-reflector centerline P vertical. The semi-spherical support member 42, attached to antenna array 26, rotates with antenna array 26 between the extreme rotation positions. The angle of total rotation between the extreme rotation positions is about 90 degrees. The geared platen 38 is rotationally supported by a platen support 50. The platen support 50 is connected to the aircraft fuselage 14 by other support structure (not shown) such that the platen support 50 is fixed in position and cannot rotate.

Figure 6:
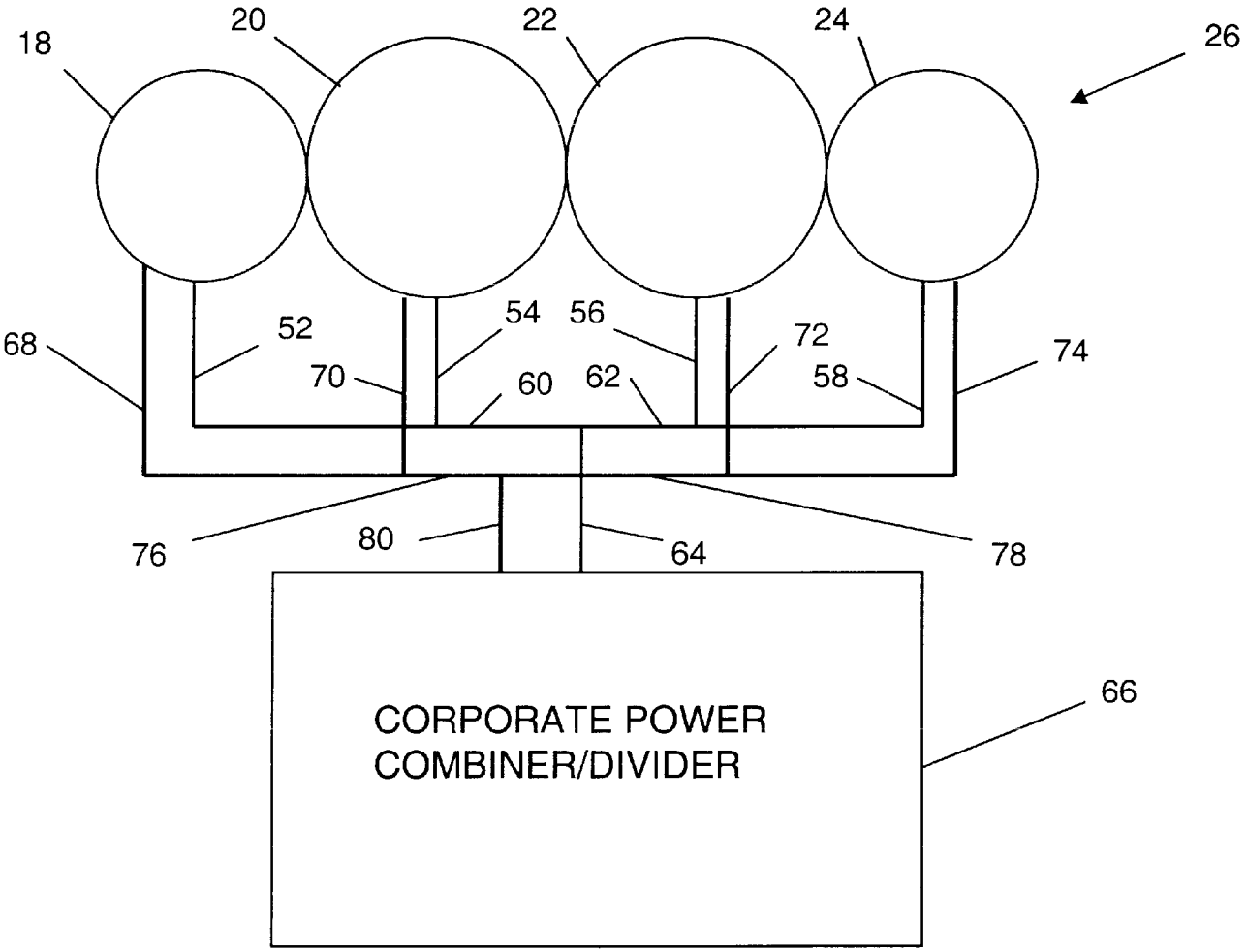
FIG. 6 is a block diagram showing the antenna array of the present invention connected to a corporate power combiner/divider.

FIG. 6 shows an exemplary arrangement of signal lines into the antenna array 26. A first vertical signal line 52 serving first reflector antenna 18 connects with a second vertical signal line 54 serving second reflector antenna 20. A third vertical signal line 56 serving third reflector antenna 22 connects with a fourth vertical signal line 58 serving fourth reflector antenna 24. First vertical signal line 52 and second vertical signal line 54 join as a combined vertical signal line 60, and third vertical signal line 56 and the fourth vertical signal line 58 join as a combined vertical signal line 62. Combined vertical signal lines 60 and 62 are connected as a vertical signal input/output line 64 for a corporate power combiner/divider 66.

FIG. 6 also shows a first horizontal signal line 68 serving first reflector antenna 18 connecting with a second horizontal signal line 70 serving second reflector antenna 20. A third horizontal signal line 72 serving third reflector antenna 22 connects with a fourth horizontal signal line 74 serving fourth reflector antenna 24. First horizontal signal line 68 and second horizontal signal line 70 join as a combined horizontal signal line 76. The third horizontal signal line 72 and the fourth horizontal signal line 74 join as a combined horizontal signal line 78. Combined horizontal signal lines 76 and 78 are connected as a horizontal signal input/output line 80 for corporate power combiner/divider 66.

Corporate power combiner/divider 66 processes the vertical and horizontal signals for each of the four reflector antennas. Within the corporate power combiner/divider 66, a network (not shown) is employed which adjusts the amplitude and the phase of the signal from each of the antennas processed. This network is in addition to the processing which is conducted on the feedhorn/reflector system of the antenna array 26. Antenna pattern performance is enhanced by adjusting the amplitude and phase of the individual antenna signals within the corporate power combiner/divider 66.

Other structural support designs for the antenna array 26 are also possible without departing from the spirit and scope of the invention. These include, but are not limited to: (1) a single support plate having cutouts for each antenna, (2) supports comprising a round tube, a square tube, a flat strip or various geometric shapes, or (3) a single centrally located support member having one or more individual support arms for each antenna. A variety of materials for the array supports may be used including steels, aluminum and plastics.

Antenna array 26 can also be designed for less than 4 or more than 4 reflector antennas without departing from the spirit and scope of the invention. The four reflector antenna design disclosed herein is an exemplary design. Providing fewer than the exemplary 4 reflector antennas reduces structure at the cost of a larger height array having greater aerodynamic drag. Providing more than the exemplary 4 reflector antennas increases structural and electronics complexity but provides the benefit of a smaller height array having reduced aerodynamic drag. An optimum design point must be selected based on all the aircraft design parameters.

The plurality of sub-reflector struts supporting the sub-reflector for each antenna can also be replaced by a single dielectric tube (not shown) for each antenna. The dielectric tube must be dimensioned such that antenna array 26 can still be rotated within radome 12. Exemplary vertical and horizontal solid state power amplifiers (SSPAs) for the single reflector antenna 16 producing 20 watts, have an efficiency of about 15 percent. The vertical and horizontal SSPAs of four smaller antennas in antenna array 26 producing an exemplary 5 watts each (for the same total of 20 watts output) have an efficiency of about 25 percent. It is therefore advantageous to use an appropriate number of smaller, more efficient antennas than a single larger antenna if smaller antennas can be employed.

The array of the present invention provides several advantages. By reducing the height of a wide-bandwidth reflector antenna by dividing the antenna aperture area into an array of smaller reflector antennas, the vertical height of the antenna array is reduced, which results in reduced aerodynamic drag on the aircraft. Antenna pattern performance is enhanced by the added control of the amplitude and phase of the individual antenna signals provided by the corporate feed network, in addition to the normally adjusted amplitude and phase of the feedhorn/reflector system. Also, the use of a multiple reflector array antenna system allows the use of smaller, more efficient, lower power solid state power amplifiers. The combined effect of using multiple antennas having multiple smaller power amplifiers provides more efficient power consumption than would be provided by power amplifier(s) of a single antenna.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A multiple element antenna array adapted to be mounted to an exterior surface of a mobile platform, to simultaneously transmit and receive communication signals, comprising:

a plurality of reflector antennas forming an antenna array;

said antenna array arranged on a common horizontal axis;

a support structure for mounting said antenna array on said common horizontal axis;

a drive mechanism to permit multi-plane movement of said support structure about at least one of a vertical and horizontal axis of rotation; and at least one motor to rotate said drive mechanism.

2. The multiple element antenna array of claim 1, wherein said antenna array, said support structure, said drive mechanism and said at least one motor form an antenna assembly; and further comprises a radome to at least partially enclose said antenna assembly.

3. The multiple element antenna array of claim 1 further comprising:

a sub-reflector connected to each of said plurality of reflector antennas to thereby form a group of cassegrain reflector antennas.

4. The multiple element antenna array of claim 3, further comprising a dielectric tube to connect each said sub-reflector to its associated said reflector antenna.

5. The multiple element antenna array of claim 2, further comprising a plurality of struts to connect each said sub-reflector to its associated said reflector antenna.

6. The multiple element antenna array of claim 1, further comprising:

a center point of each said reflector antenna, each said center point aligned on the common horizontal axis; and said support structure having at least one semi-spherical support member, said semi-spherical support member being attached to each said reflector antenna.

7. The multiple element antenna array of claim 6 further comprising:

a plurality of subreflectors associated with said reflector antennas to thereby form a plurality of cassegrain reflector antennas;

said cassegrain reflector antennas forming a first pair of adjacent large diameter reflector antennas and a second pair of small diameter reflector antennas;

said second pair of small diameter reflector antennas being arranged each adjacent to a preselected one of the first pair of adjacent large diameter reflector antennas; and a central vertical axis of rotation disposed between said first pair of adjacent large diameter reflector antennas.

8. The multiple element antenna array of claim 7, wherein said motor comprises an azimuth stepper motor, said azimuth stepper motor being operable to rotate said antenna array about said central vertical axis of rotation to thereby position said antenna array in accordance with a desired azimuth scanning angle.

9. The multiple element antenna array of claim 8, further comprising:

an elevation stepper motor;

said elevation stepper motor connected to said at least one semi-spherical support member operably associated with said antenna array; and said elevation stepper motor operating to rotate said antenna array about said central horizontal axis of rotation to thereby position said antenna array in accordance with a desired elevation scanning angle.

10. The multiple element antenna array of claim 7, further comprising:

a corporate power combiner/divider; and wherein said combiner/divider processes both a transmit and a receive signal for each of said reflector antennas.

11. The multiple element antenna array of claim 2, further comprising:

an antenna rear support member formed of a graphite-epoxy material covering a foam core; and said rear support member covers at least a face of each said reflector antenna.

12. An antenna array adapted to be mounted to an exterior surface of a high speed mobile platform such as an aircraft, for both transmitting and receiving Ku-band communication signals while providing a low profile, aerodynamically efficient substructure, said antenna array comprising:

an array of a plurality of cassegrain reflector antennas;

a support structure for mounting each of said reflector antennas;

a drive mechanism to permit movement of the support structure to mechanically scan said array about both X and Y axes;

a first motor to control vertical motion of said drive mechanism about said X axis;

a second motor to control horizontal motion of said drive mechanism about said Y axis;

a radome for enclosing said antenna array; and said radome having an internal volume sufficient to permit mechanical scanning of said array about said X and Y axes within said radome by the first and second motors.

13. The antenna array of claim 12, wherein said array is adapted to be mounted to an exterior surface of said aircraft.

14. The antenna array of claim 13, wherein said radome is sized to minimize aerodynamic drag on said aircraft.

15. An aircraft communication system comprising:

a plurality of cassegrain reflector antennas;

a support structure for mounting each of the cassegrain reflector antennas;

a drive mechanism to permit mechanically scanning said support structure about X and Y axes;

a corporate power combiner/divider in electrical communication with each of the cassegrain reflector antennas;

said combiner/divider operating to process both a transmit and a receive signal for each of the cassegrain reflector antennas;

a radome enclosing said cassegrain reflector antennas; and said radome reducing an aerodynamic drag of said cassegrain reflector antennas on said aircraft.

16. The aircraft communication system of claim 15, wherein the corporate power combiner/divider comprises:

a network to adjust an amplitude of the signals processed; and a network to adjust a phase of the signals processed.

17. The antenna array of claim 15, further comprising:

a first network within the corporate power combiner/divider for adjusting an amplitude of each said receive and transmit signal processed.

18. The antenna array of claim 17 further comprising:

a second network within the corporate power combiner/divide for adjusting a phase of each said receive and transmit signal processed.

19. The antenna array of claim 18, further comprising:

a feedhorn reflector system; and said feedhorn reflector system having both an amplitude signal adjustment and a phase signal adjustment for adjusting an antenna pattern performance of each of said cassegrain reflector antennas.

20. The antenna array of claim 15, wherein said cassegrain reflector antennas are simultaneously mechanically scannable to a single target.

21. The antenna array of claim 15, wherein said transmit signal comprises a frequency range of about 14.0 GHz to about 14.5 GHz and said receive signal comprises a frequency range of about 11.2 GHz to about 12.7 GHz.

* * * * *